US010102837B1

(12) United States Patent
Matsunaga

(10) Patent No.: US 10,102,837 B1
(45) Date of Patent: Oct. 16, 2018

(54) RESONANCE SOUND CONTROL DEVICE AND RESONANCE SOUND LOCALIZATION CONTROL METHOD

(71) Applicant: KAWAI MUSICAL INSTRUMENTS MANUFACTURING CO., LTD., Shizuoka (JP)

(72) Inventor: Kaoru Matsunaga, Shizuoka (JP)

(73) Assignee: KAWAI MUSICAL INSTRUMENTS MANUFACTURING CO., LTD., Shizuoka (JP)

( * ) Notice: Subject to any disclaimer, the term of this patent is extended or adjusted under 35 U.S.C. 154(b) by 0 days.

(21) Appl. No.: 15/949,576

(22) Filed: Apr. 10, 2018

(30) Foreign Application Priority Data

Apr. 17, 2017 (JP) ..... 2017-081399

(51) Int. Cl.
*G10H 1/00* (2006.01)
*G10H 1/053* (2006.01)
*G10H 1/34* (2006.01)

(52) U.S. Cl.
CPC ..... *G10H 1/053* (2013.01); *G10H 1/0008* (2013.01); *G10H 1/344* (2013.01); *G10H 2210/195* (2013.01); *G10H 2210/305* (2013.01); *G10H 2220/221* (2013.01)

(58) Field of Classification Search
CPC ..... G10H 1/053; G10H 1/0008; G10H 1/344; G10H 2210/195
USPC ..... 84/626
See application file for complete search history.

(56) References Cited

U.S. PATENT DOCUMENTS 5,455,380 A * 10/1995 Matsuda ..... G10H 1/0091 84/662
6,031,173 A * 2/2000 Ikeda ..... G10H 7/002 84/605
6,931,134 B1 * 8/2005 Waller, Jr. ..... G10H 1/0091 381/119
6,990,435 B2 * 1/2006 Kaneko ..... G01L 1/205 340/665
7,309,829 B1 * 12/2007 Ludwig ..... G10H 1/00 84/609
8,633,370 B1 * 1/2014 Raley ..... G10H 1/0083 84/723
8,653,354 B1 * 2/2014 Van Buskirk ..... G10H 1/125 84/609
9,697,816 B2 * 7/2017 Osuga ..... G10H 1/344
2002/0148346 A1 * 10/2002 Okulov ..... G10H 1/342 84/613

(Continued)

FOREIGN PATENT DOCUMENTS

JP H04-116694 A 4/1992

*Primary Examiner* — David Warren
(74) *Attorney, Agent, or Firm* — Westman, Champlin & Koehler, P.A.

(57) ABSTRACT

An electronic piano including a plurality of keys and a sound source device (sound emission section) that emits a sound by pressing down the key, is provided with a resonance circuit that stereo-inputs a sound source from the sound source device corresponding to the each key, a plurality of resonance circuit groups that execute a stereo mix process with the plurality of resonance circuits being made one group, and delay circuits that provide a time difference to each stereo output from the each resonance circuit group, and outputs of the respective delay circuits are synthesized to obtain a stereo output.

4 Claims, 3 Drawing Sheets

(56) References Cited

U.S. PATENT DOCUMENTS

2002/0166441 A1* 11/2002 Washiyama ..... G10H 1/0091
84/662
2005/0120870 A1* 6/2005 Ludwig ..... G10H 1/00
84/661
2008/0212667 A1* 9/2008 Sauer ..... G10H 1/0091
375/231
2009/0183624 A1* 7/2009 Kira ..... G10H 1/24
84/622
2009/0235803 A1* 9/2009 Iwamoto ..... G10H 1/346
84/229
2012/0247309 A1* 10/2012 Matsuda ..... G10H 1/0091
84/735
2015/0221296 A1* 8/2015 Nakata ..... G10H 1/06
84/725
2015/0228261 A1* 8/2015 Nakata ..... G10H 1/06
84/622
2015/0262559 A1* 9/2015 Beck ..... G10H 1/0016
84/645
2015/0268921 A1* 9/2015 Georges ..... G05B 15/02
700/94
2016/0225360 A1* 8/2016 Osuga ..... G10H 1/344
2016/0284329 A1* 9/2016 Itoh ..... G10H 1/06

* cited by examiner

RESONANCE SOUND CONTROL DEVICE AND RESONANCE SOUND LOCALIZATION CONTROL METHOD

TECHNICAL FIELD

The present invention relates to an effect provision device in an electronic piano, and relates specifically to a resonance sound control device and a resonance sound localization control method capable of reproducing resonance of strings (damper resonance) with natural localization, the resonance of strings being generated in pressing an optional key in a state where a damper pedal is stepped down in an acoustic piano.

BACKGROUND ART

In the case of an acoustic piano, when a damper pedal is stepped down, a damper felt gets away from each string according to rotation of a damper lever in all keys. When an optional key is pressed in this state, an action comes into operation responding pressing of the key, a hammer strikes a string, vibration of the string is transferred to a sound board, a music sound is emitted, and resonance (damper resonance) comes to be generated between all other strings. It is configured that the damper felt is in contact with the string and suppresses vibration at the normal time (when the damper pedal is not stepped down).

In the case of an electronic piano, it is conducted to improve reality of the sound by providing various additional sounds and additional effects other than the actual sound of the piano which becomes main, and to make the sound similar to the emitted sound of an acoustic piano.

In order to reproduce the damper resonance described above, in an electronic piano of a related art, a process of providing an effect of resonance to a sound source at the time a music sound was emitted (stereo output process of the damper resonance) was conducted.

In a stereo output process of the damper resonance, a signal outputted eventually was created by providing left and right sound volume for localization with respect to plural resonance sounds and synthesizing the output of the positive phase and the reverse phase.

Also, in Japanese Patent No. 3061403, there is disclosed a technology for providing an echo after localization with respect to the sound of a pipe organ in an electronic musical instrument imitating the sound of a pipe organ.

CITATION LIST

Patent Literatures

Patent Literature 1: Japanese Patent Publication No. 3061403

SUMMARY OF INVENTION

Technical Problem

However, in the stereo output process of the damper resonance conducted in an electronic piano of the related art, there were such problems that a sound image became flat in the case of providing localization by a sound volume difference, and that localization was indefinite and became unnatural in the case of providing localization by the synthesizing process of the positive phase and the reverse phase.

Further, although more natural localization can be reproduced in synthesizing with a left and right time difference being provided to the resonance sound of each key, there was a problem that a buffer memory having a large capacity was required for providing a time difference in each key and the configuration became large which was not realistic.

Further, although an echo is provided after localizing the resonance sound according to Japanese Patent No. 3061403, it is not a process of grouping the resonance sound.

The present invention was proposed in view of the circumstances described above, and its object is to provide a resonance sound control device and a resonance sound localization control method capable of reproducing natural localization without employing a large configuration with respect to provision of a resonance sound in an electronic piano.

Solution to Problems

To achieve the above object, a resonance sound control device in an electronic piano including a plurality of keys and a sound emission section that emits a sound by pressing down the key according to a first aspect (Claim 1) of the present invention, comprising:

resonance circuits that respectively stereo-input a sound source from the sound emission section corresponding to the each key;

a plurality of resonance circuit groups that execute a stereo mix process with the plurality of resonance circuits being made one group; and delay circuits that respectively provide a time difference to each stereo output from the each resonance circuit group, wherein outputs of the each of the delay circuits are synthesized to obtain a stereo output.

The present invention of the Claim 2 is the resonance sound control device according to claim 1, wherein the stereo output from the plurality of resonance circuits that configure the each group is provided with a left and right sound volume difference according to a key position in a keyboard.

The present invention of the Claim 3 is the resonance sound control device according to claim 1, wherein the stereo output from the each resonance circuit group is provided with different delay time according to a key position in a keyboard.

The present invention of the Claim 4 is a resonance sound localization control method, comprising the steps of:

forming a plurality of resonance circuit groups with a plurality of resonance circuits for each of a plurality of keys being made one group;

executing a stereo mix process of inputting an actual sound from a sound source to the each resonance circuit that configures the each resonance circuit group and providing a sound volume difference;

providing a time difference to each stereo output from the each resonance circuit group through each delay circuit; and synthesizing the respective stereo outputs from the each delay circuit to obtain a stereo output.

Advantageous Effects of Invention

According to the present invention, in an electronic piano, by grouping the resonance circuits corresponding to respective keys, adding the left and right outputs within the groups to each other, and thereafter providing a time difference to the delay circuits, the stereo output with natural localization can be obtained without requiring a memory with a large capacity.

BRIEF DESCRIPTION OF DRAWINGS

An Embodiment of the present invention will be described in detail based on the following drawings.

DESCRIPTION OF EMBODIMENTS

Figure 1:
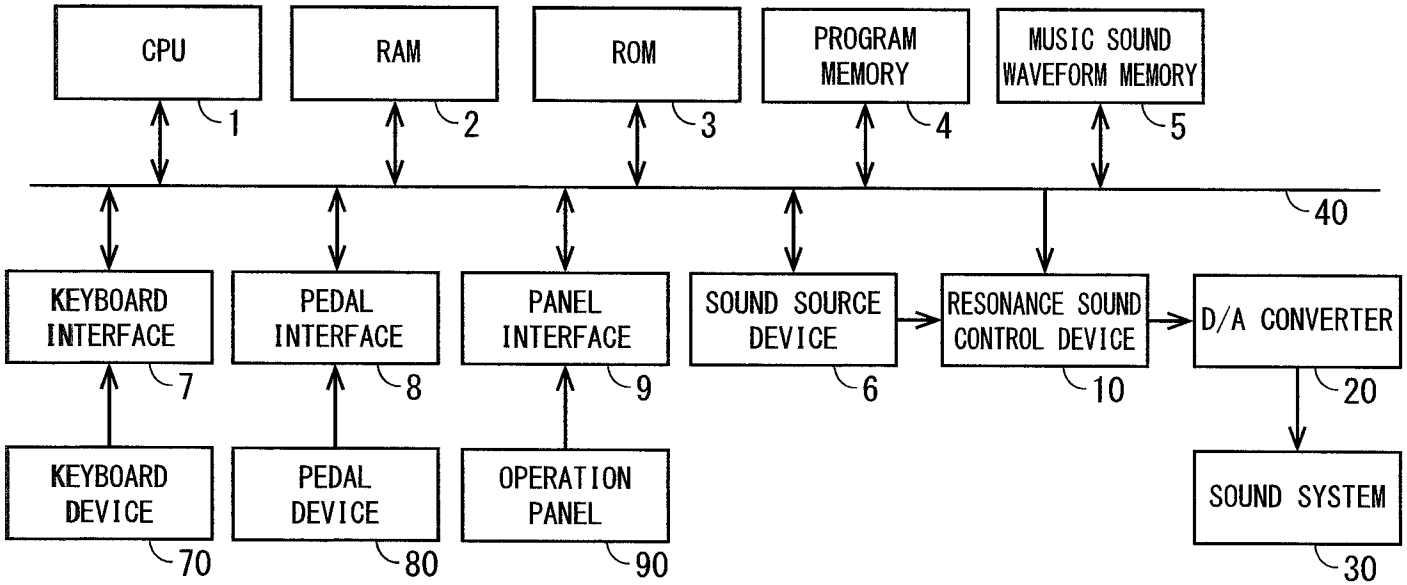
FIG. 1 is a block diagram showing a hardware configuration of an electronic piano including a resonance sound control device according to an embodiment of the present invention.

Hereinafter, a resonance sound emission device according to an embodiment of the present invention will be explained referring to the drawings. FIG. 1 is a block diagram showing a hardware configuration of an electronic piano including a resonance sound control device 10 according to an embodiment of the present invention.

In the drawing, a CPU 1, a RAM 2, a ROM 3, a program memory 4, a music sound waveform memory 5, a sound source device 6 as a sound emission section, a keyboard interface 7, a pedal interface 8, a panel interface 9, and a resonance sound control device 10 are connected to a bus line 40.

A keyboard device 70 is connected to the keyboard interface 7, a pedal device 80 is connected to the pedal interface 8, and an operation panel 90 is connected to the panel interface 9 respectively.

The keyboard device 70 includes plural (88 keys for example) keys and a key sensor that detects the pressing down amount of each key.

The keyboard interface 7 creates key event information and touch information based on an output signal of the key sensor. The information of them is linked to the key number, and is stored in the RAM 2.

The pedal device 80 is arranged in order to reproduce, by an electronic piano, an effect achieved by stepping of each pedal in an acoustic piano. The pedal device 80 includes a damper pedal that makes all strings to resonate, a sostenuto pedal that makes a specific string to resonate, a soft pedal that reduces the sound emission, and sensors (volume) that detect the stepping amount of these pedals. The sensor (volume) that detects the stepping amount of the damper pedal is configured to be capable of detecting the stepping amount in eight stages for example, and is configured to be controllable according to the stepping amount.

A digital/analog converter 20 is connected to the resonance sound control device 10, and a sound system 30 including amplifiers and speakers is connected to the digital/analog converter 20. The amplifier and the speaker are arranged by two sets so as to be capable of controlling the direction of the sound image and to effect stereo-outputting.

The CPU 1 controls each configuration elements according to a control program that is stored in the program memory 4. Waveform data corresponding to plural timbres are stored in the music sound waveform memory 5, and a parameter for processing the music sound waveform data and creating a music sound is stored in the ROM 3. The RAM 2 is used as a work area that temporarily stores various data when the CPU 1 executes a program. The operation panel 90 includes an LCD screen, various switches and volumes, and display lamps such as an LED, and is disposed on a control panel that is arranged adjacently to the keyboard device 70 for example.

At the time of a performance, music sound waveform data are read out from the music sound waveform memory 5 to the sound source device 6 in response to a key-on signal that is inputted from the keyboard device 70. The music sound waveform data are read out at a frequency corresponding to the key-on number included in the key-on signal. In the sound source device 6, with respect to the music sound waveform data having been read out, processes of the envelope control, addition of effects, and so on are practiced, the envelope control including formation of an attack section according to the velocity, and a music sound signal is created. The music sound signal is provided with a resonance sound by the resonance sound control device 10, is converted to an analog music sound signal by the digital/analog converter 20, and is thereafter fed to the sound system 30. In the sound system 30, the analog music sound signal is amplified by the amplifiers, and is sounded by the speakers.

Figure 2:
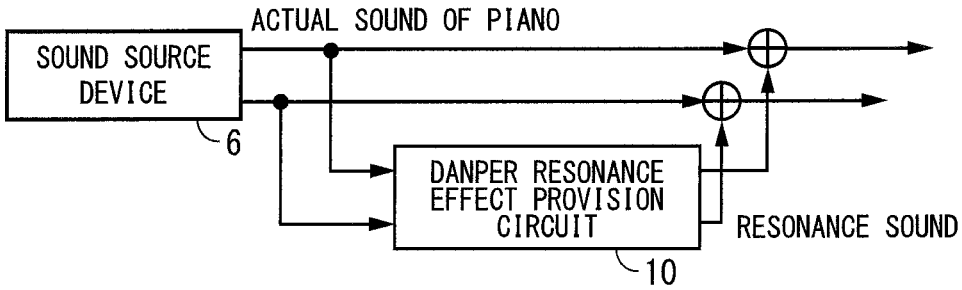
FIG. 2 is a block diagram showing a configuration of the resonance sound control device.

As shown in FIG. 2, the resonance sound control device 10 of an aspect of the present invention is a device that creates a resonance sound (damper resonance) of a string in a state where the damper gets away by the damper resonance effect provision circuit, and adds the resonance sound to the sound source (an actual sound of a piano).

Figure 3:
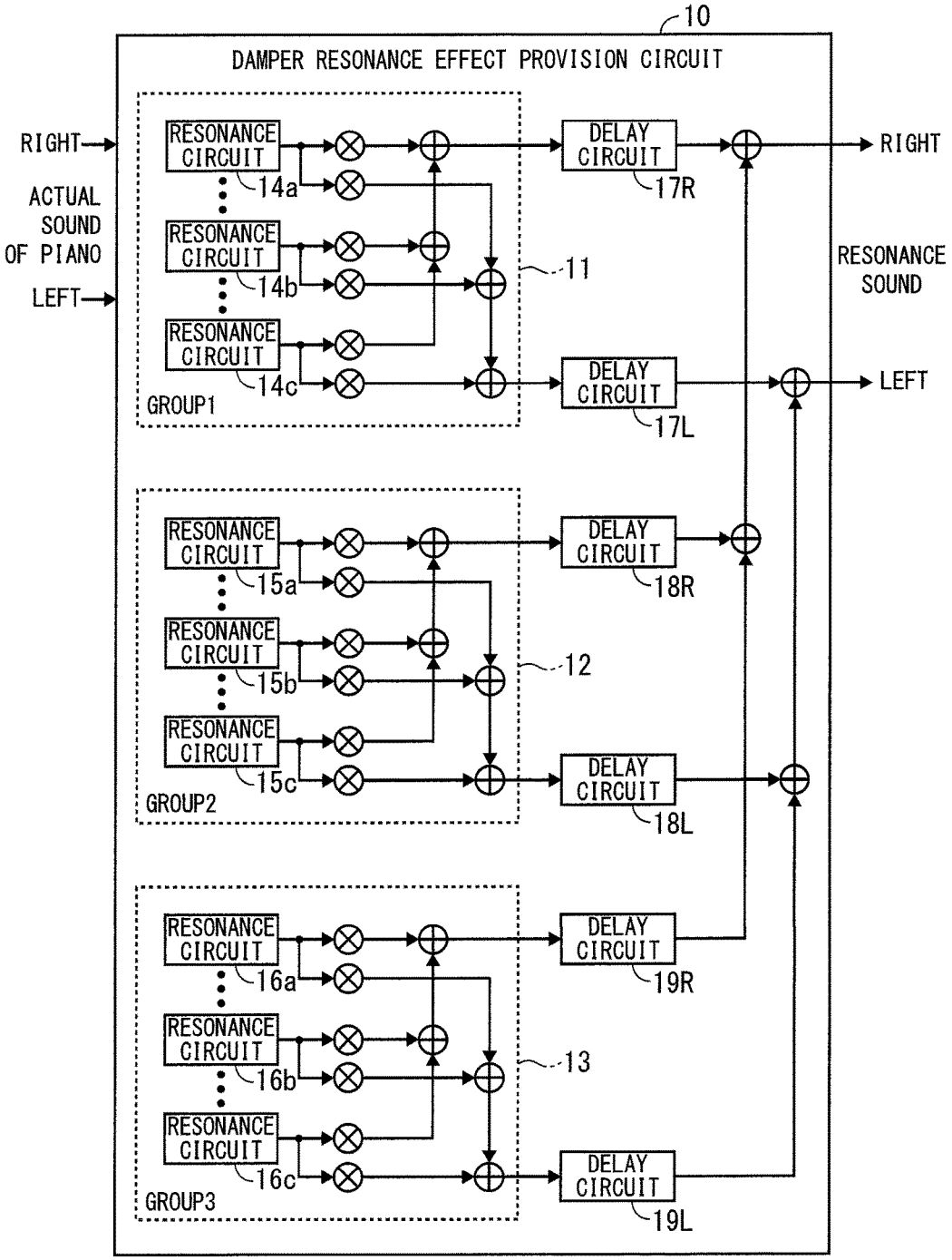
FIG. 3 is a block diagram showing a detailed configuration of a damper resonance effect provision circuit.

As shown in FIG. 3, this damper resonance effect provision circuit (resonance sound control device) 10 includes respective resonance circuits corresponding to plural (88 pieces for example) keys respectively. With respect to plural resonance circuit groups, several pieces configure one resonance circuit group. In this example, with respect to plural resonance circuits, three groups of a resonance circuit group 11, a resonance circuit group 12, and a resonance circuit group 13 are formed, and a stereo mix process of a sound volume difference, positive phase/reverse phase, and so on is executed within the group.

Each resonance circuit 14(14*a*, 14*b*, 14*c*) forming the resonance circuit group 11 turns the stereo-inputted sound source (an actual sound of a piano) into a monaural phonic, and stereo-outputs the same so as to cause a left and right sound volume difference. For example, in the resonance circuit 14*a*, the inputted sound with the sound volume 1.0 is outputted providing the sound volume difference at a rate of the right side output 0.9 and the left side output 0.1. In the resonance circuit 14*b*, the inputted sound with the sound volume 1.0 is outputted providing the sound volume difference at a rate of the right side output 0.8 and the left side output 0.2. In the resonance circuit 14*c*, the inputted sound with the sound volume 1.0 is outputted providing the sound volume difference at a rate of the right side output 0.7 and the left side output 0.3.

The right side output of each resonance circuit 14*a*, 14*b*, 14*c* and the left side output of each resonance circuit 14*a*, 14*b*, 14*c* are added respectively and are outputted through a delay circuit 17R and a delay circuit 17L, and thereby a time difference is provided to the left and right outputs.

Similarly each resonance circuit 15(15*a*, 15*b*, 15*c*) forming the resonance circuit group 12 turns the stereo-inputted sound source (an actual sound of a piano) into a monaural phonic, and stereo-outputs the same so as to cause a left and right sound volume difference. For example, in the resonance circuit 15*a*, the inputted sound with the sound volume 1.0 is outputted providing the sound volume difference at a rate of the right side output 0.6 and the left side output 0.4.

In the resonance circuit 15*b*, the inputted sound with the sound volume 1.0 is outputted providing the sound volume difference at a rate of the right side output 0.5 and the left side output 0.5. In the resonance circuit 15*c*, the inputted sound with the sound volume 1.0 is outputted providing the sound volume difference at a rate of the right side output 0.4 and the left side output 0.6.

The right side output of each resonance circuit 15*a*, 15*b*, 15*c* and the left side output of each resonance circuit 15*a*, 15*b*, 15*c* are added respectively and are outputted through a delay circuit 18R and a delay circuit 18L, and thereby a time difference is provided to the left and right outputs.

Similarly each resonance circuit 16(16*a*, 16*b*, 16*c*) forming the resonance circuit group 13 turns the stereo-inputted sound source (an actual sound of a piano) into a monaural phonic, and stereo-outputs the same so as to cause a left and right sound volume difference. For example, in the resonance circuit 16*a*, the inputted sound with the sound volume 1.0 is outputted providing the sound volume difference at a rate of the right side output 0.3 and the left side output 0.7. In the resonance circuit 16*b*, the inputted sound with the sound volume 1.0 is outputted providing the sound volume difference at a rate of the right side output 0.2 and the left side output 0.8. In the resonance circuit 16*c*, the inputted sound with the sound volume 1.0 is outputted providing the sound volume difference at a rate of the right side output 0.1 and the left side output 0.9.

The right side output of each resonance circuit 16*a*, 16*b*, 16*c* and the left side output of each resonance circuit 16*a*, 16*b*, 16*c* are added respectively and are outputted through a delay circuit 19R and a delay circuit 19L, and thereby a time difference is provided to the left and right outputs.

Also, with respect to the delay time by each of delay circuits 17(17R, 17L), 18(18R, 18L), 19(19R, 19L) for each stereo outputs from the resonance circuit groups 11, 12, 13, different delay time is given for each group according to the key position of the group (the right side, the center, and the left side facing the keyboard).

Finally, the stereo output with each time difference processed for each group (the output from each delay circuit) is synthesized independently for the left and right, and is stereo-outputted. By such process, with respect to the outputted resonance sound (the right side and the left side), a left and right sound volume difference and a time difference are provided according to the key position in the keyboard, and a clear stereo effect can be given.

Also, with respect to the sound volume difference in the output of each of resonance circuits 14(14*a* to 14*c*), 15(15*a* to 15*c*), 16(16*a* to 16*c*) and the time difference in each of delay circuits 17(17R, 17L), 18(18R, 18L), 19(19R, 19L), preset rate and delay time are used.

Although plural keys were divided into three groups in the resonance sound control device (damper resonance effect provision circuit) 10 described above, it is also possible to divide the plural keys into four groups or more.

According to the resonance sound control device (damper resonance effect provision circuit) 10 described above, in an electronic piano, by grouping the resonance circuits 14(14*a* to 14*c*), 15(15*a* to 15*c*), 16(16*a* to 16*c*) corresponding to respective keys, adding the left and right outputs within the resonance circuit groups 11, 12, 13 to each other, and thereafter providing a time difference to the delay circuits 17(17R, 17L), 18(18R, 18L), 19(19R, 19L), the stereo output with natural localization can be obtained without requiring a memory with a large capacity.

REFERENCE SIGNS LIST

1 . . . CPU,
2 . . . RAM,
3 . . . ROM,
4 . . . program memory,
5 . . . music sound waveform memory,
6 . . . sound source device (sound emission section),
7 . . . keyboard interface,
8 . . . pedal interface,
9 . . . panel interface,
10 . . . damper resonance effect provision circuit (resonance sound control device),
11, 12, 13 . . . resonance circuit group,
14, 15, 16 . . . resonance circuit,
17R, 18R, 19R . . . delay circuit,
17L, 18L, 19L . . . delay circuit,
20 . . . digital/analog converter,
30 . . . sound system,
40 . . . bus line,
70 . . . keyboard device,
80 . . . pedal device,
90 . . . operation pane

What is claimed is:

1. A resonance sound control device in an electronic piano including a plurality of keys and a sound emission section that emits a sound by pressing down the key, comprising:

resonance circuits that respectively stereo-input a sound source from the sound emission section corresponding to the each key;

a plurality of resonance circuit groups that execute a stereo mix process with the plurality of resonance circuits being made one group; and delay circuits that respectively provide a time difference to each stereo output from the each resonance circuit group, wherein outputs of the each of the delay circuits are synthesized to obtain a stereo output.

2. The resonance sound control device according to claim 1, wherein the stereo output from the plurality of resonance circuits that configure the each group is provided with a left and right sound volume difference according to a key position in a keyboard.

3. The resonance sound control device according to claim 1, wherein the stereo output from the each resonance circuit group is provided with different delay time according to a key position in a keyboard.

4. A resonance sound localization control method, comprising the steps of:

forming a plurality of resonance circuit groups with a plurality of resonance circuits for each of a plurality of keys being made one group;

executing a stereo mix process of inputting an actual sound from a sound source to the each resonance circuit that configures the each resonance circuit group and providing a sound volume difference;

providing a time difference to each stereo output from the each resonance circuit group through each delay circuit; and synthesizing the respective stereo outputs from the each delay circuit to obtain a stereo output.

* * * * *